United States Patent [19]

Jessup

[11] Patent Number: 4,812,146

[45] Date of Patent: Mar. 14, 1989

[54] LIQUID FUELS OF HIGH OCTANE VALUES

[75] Inventor: Peter J. Jessup, Santa Ana, Calif.

[73] Assignee: Union Oil Company of California, Los Angeles, Calif.

[21] Appl. No.: 204,624

[22] Filed: Jun. 9, 1988

[51] Int. Cl.[4] ..... C10L 1/18; C10L 1/06

[52] U.S. Cl. ..... 44/77; 44/53; 44/56

[58] Field of Search ..... 44/77, 56

[56] References Cited

U.S. PATENT DOCUMENTS

| | | | |
|---|---|---|---|
| 4,080,180 | 3/1978 | Lyons | 44/77 |
| 4,207,077 | 6/1980 | Bove et al. | 44/77 |
| 4,353,710 | 10/1982 | Sweeney et al. | 44/77 |
| 4,412,847 | 11/1983 | Dolhyi et al. | 44/77 |
| 4,516,981 | 5/1985 | Nelson, Jr. et al. | 44/77 |
| 4,519,809 | 5/1985 | Hochhausen | 44/53 |
| 4,610,696 | 9/1986 | Bernasconi et al. | 44/77 |
| 4,723,963 | 2/1988 | Taylor | 44/77 |
| 4,738,686 | 4/1988 | Dillon et al. | 44/77 |

FOREIGN PATENT DOCUMENTS

| | | | |
|---|---|---|---|
| 224329 | 7/1985 | Fed. Rep. of Germany | 44/77 |
| 7217356 | 1/1973 | Netherlands | 44/77 |

*Primary Examiner*—William R. Dixon, Jr.
*Assistant Examiner*—Ellen McAvoy
*Attorney, Agent, or Firm*—Gregory F. Wirzbicki

[57] ABSTRACT

A fuel composition has an octane rating of at least about 100 and is comprised of toluene and alkylate and at least two further components selected from the group consisting of isophentane, n-butane, and methyl tertiary-butyl ether.

83 Claims, No Drawings

LIQUID FUELS OF HIGH OCTANE VALUES

BACKGROUND OF THE INVENTION

This invention relates to liquid fuels of high octane rating, in particular gasolines of octane rating at or above 100.

It is well known, in the operation of spark-induced combustion engines, and particularly automotive engines operating on gasoline, that the octane rating of the fuel must be high enough to prevent knocking. Gasolines sold at service stations typically have an octane rating between about 87 and 93, and fuels of such octane values are satisfactory for most automotive engines.

However, for high performance engines, and for racing engines in particular, fuels of even higher octane ratings are required. As is well known, the production of fuels of progressively higher octane values is progressively more difficult to achieve. In particular, fuels of octane value at or above 100 are highly desired and correspondingly the most difficult to produce, particularly for unleaded fuels (since one of the best known octane enhancers for fuels is tetraethyllead).

SUMMARY OF THE INVENTION

The present invention is directed to fuel compositions which (1) have an octane value of at least about 100 and (2) comprise toluene and alkylate and at least two components selected from the group consisting of butane, isopentane, and methyl tertiary-butyl ether (MTBE).

DETAILED DESCRIPTION OF THE INVENTION

In the present invention, a fuel composition is provided containing at least four components selected from the group consisting of butane, isopentane, toluene, MTBE, and alkylate, with alkylate being one such component and toluene another, said fuel having an octane value of about 100 or more. Unless otherwise indicated herein, all octane values are calculated as the sum of the ASTM research method and motor method octane values divided by 2, i.e., (R+M)/2. As used herein, the term "about 100" in reference to octane rating is meant to include octane ratings at least as low as 99.8 whereas reference to "100" (without "about" preceding the "100") is meant to include octane ratings only as low as 99.95. In addition, all references to "butane" are to n-butane.

The term "alkylate" is herein defined as either (1) a fluid consisting essentially of isooctane or (2) a "mixed alkylate," i.e., a mixture consisting essentially of organic compounds comprising at least 75% by weight branched chain paraffins, said mixture having a research octane number greater than 93 and a motor octane number greater than 91. As used herein, the term "organic compound" refers to any compound containing at least one carbon atom. Preferred alkylates consist essentially of hydrocarbons; such preferred alkylates are readily available, e.g., as the product of an alkylation unit in oil refineries using hydrogen fluoride as a catalyst, the catalyst being used to promote the conversion of small paraffins and olefins to relatively large branched chain paraffins. Alkylates produced from a preferred alkylation unit using hydrogen fluoride catalyst are comprised of at least 75%, preferably at least 80%, more preferably at least 85%, and most preferably at least 90% branched chain paraffins, the remainder usually consisting essentially of other organic compounds, e.g., straight chain paraffins, aromatics, etc. Usually, the balance of the alkylate, i.e., the portion not branched chain paraffins, will comprise at least 50% by volume of straight chain paraffins. Typical alkylates boil in the 75° to 410° F. range, or in any range therebetween. One preferred mixed alkylate has an initial boiling point in the range of 75° to 110° F., preferably about 90° F., and an end boiling point in the range of 350° to 410° F., preferably about 375° F. Another preferred mixed alkylate has an initial boiling point of 240° F. and an end boiling point of 300° F.; yet another an initial boiling point of 300° F. and an end boiling point of 350° F.; and yet another an initial boiling point of 355° F. and an end boiling point of 410° F. Alkylates which consist essentially of isooctane generally boil in the range of about 200° to 220° F. Moreover, it should be noted that, oftentimes, the major (i.e., 50%+) proportion of a mixed alkylate will be isooctane.

It has been found that octane values of 100 or more can be achieved with the components specified above by following a specific equation (hereinafter the octane formula), i.e., $$OV = 7.427B + 0.3476I + 0.92922A + 1.07801T + 0.095M - 0.06170BI - 0.06967BA - 0.06973BT - 0.05728BM + 0.005629IA + 0.00567IT + 0.01705IM - 0.000311AT + 0.01189AM + 0.00912TM$$

where OV is the octane value, B is the concentration of butane in volume percent, I is the concentration of isopentane in volume percent, A is the concentration of alkylate in volume percent, T is the concentration of toluene in volume percent, and M is the concentration of MTBE in volume percent. It will be understood, of course, that double letters in the octane formula refer to the multiplication of the concentrations of the components designated, e.g., BI is the multiplication product of the volumetric percent of butane and the volumetric percent of isopentane.

When applying the octane formula, other components in the fuel, if any, are ignored. The fuel may, of course, and usually will, contain additives and the like which have no significant impact on octane value, e.g., dyes, deicing agents, agents for preventing exhaust valve seat wear, and the like. In one preferred embodiment of the invention, the fuel consists essentially of four or five of the above specified ingredients, i.e., the fuel contains essentially no other ingredient or ingredients having a significant effect, in total, upon octane value. As defined herein, an ingredient (if only one is present) or ingredients in combination (if more than one) do not significantly affect the octane value of the fuel if, in the concentration(s) employed, the octane value is not raised or lowered by more than about 1.0 unit. Thus, although it is not preferred, one may add an octane booster, e.g., methylcyclopentyl manganese tricarbonyl (MMT) or aniline, so as to raise the octane value, for example, from a value in the range of 99 to 100, to a value of 100 or more to meet the requirements of the present invention. Alternatively, one may add a component which may lower the octane value so long as the resultant value is still at least about 100. For example, the addition of isobutane or isobutylene will tend to lower the octane value but its presence may be desirable and preferred for other reasons, i.e., to increase the Reid vapor pressure of the fuel.

In preparing compositions of the invention, it is preferred that the concentrations of butane, isopentane, and alkylate be no more than 5 vol.%, 15 vol.%, and 90 vol.%, respectively, primarily because higher concentrations cause volatility problems. Toluene is preferably present in concentrations no more than about 60 vol.% because higher levels of aromatics in the fuel may cause problems with elastomer components and/or driveability. MTBE is preferably present in concentrations no greater than about 10 vol.%; higher concentrations tend to create air/fuel ratio difficulties and/or fail to comply with current EPA requirements as to the maximum concentration of oxygenates permitted in the fuel.

When the fuel composition consists of the four or five ingredients above specified, the octane formula has been found to be accurate within about 1, usually 0.5, and most usually 0.3 octane unit. In other words, it has been found that some fuels having a predicted octane rating between 100 and 101 may have an actual octane value between 99 and 100 (or as high as 101 to 102). Likewise, some fuels having a predicted octane value in the 99 to 100 range may have an actual value at or above 100.

The liquid fuel compositions of the invention are fuels, and may therefore be used as such. The preferred fuels are those which are suitable for combustion in automotive spark ignition engines, and even more preferably the fuels conform to the requirements of gasolines, and more preferably to unleaded gasolines, and most preferably of all to the requirements of racing gasolines. (As used herein, the term "unleaded" means a concentration of lead in the fuel no greater than 0.05 gm. of lead/gal.) At present, most unleaded gasolines are defined by the requirements of ASTM D439 specifications, and such gasolines fall into four different classes. The relevant specifications to the present invention are set forth in Table 1 as follows:

TABLE 1

| Properties | Class A | Class B | Class C | Class D |
|---|---|---|---|---|
| RVP (psi) max. | 9 | 10 | 11.5 | 13 |
| Dist. 10% (°F.) max. | 158 | 149 | 140 | 131 |
| Dist. 50% (°F.) | 170–250 | 170–245 | 170–240 | 170–234 |
| Dist. 90% (°F.) max. | 374 | 374 | 365 | 365 |

The most preferred gasolines produced in accordance with the invention are those which meet the requirements of one or more of the four classes specified in Table 1. In addition, for racing gasolines, it is usually necessary for the V/L ratio as measured at 145° F. to be below about 12, and preferably below about 8.5, with the lower the ratio the better, e.g., about 6.0 and below being highly desirable. However, although the octane formula is useful for preparing fuel compositions meeting the requirements of gasoline, and even those satisfying the stringent requirements of racing gasolines, the octane formula can also be used to find fuels with octane values of at least about 100 which do not meet some of the ASTM D439 volatility specifications but which are still suitable for combustion purposes.

The following examples are set forth to illustrate several different embodiments of the invention. The invention is not meant to be limited by the examples, but only by the claims hereinafter set forth. All compositions illustrated in the examples are unleaded fuels.

EXAMPLE I

A preferred fuel composition of the invention containing butane is shown in Table 2 as follows:

TABLE 2

| Blend #1 | |
|---|---|
| Butane | 5.0 vol. % |
| Toluene | 52.6 vol. % |
| Isopentane | 3.4 vol. % |
| Alkylate | 29.0 vol. % |
| MTBE | 10.0 vol. % |
| Predicted Octane Value* | 100.5 |
| Actual Octane Value | 100.7 |
| RVP (psi) | 5.65 |
| V/L at 145° F. | 7.3 |
| Dist. 10% (°F.) | 148 |
| Dist. 50% (°F.) | 216 |
| Dist. 90% (°F.) | 229 |

*"Predicted Octane Value" in this table and entire specification refers to the value as predicted by the octane formula.

The composition of Table 2 meets all the relevant requirements of ASTM D439 class A and B unleaded gasolines.

EXAMPLE II

Six fuel compositions were prepared in accordance with the octane formula. These compositions are identified in Table 3, as are the predicted and actual octane values.

TABLE 3

| Blend # | 2 | 3 | 4 | 5 | 6 | 7 |
|---|---|---|---|---|---|---|
| Butane, vol. % | 5.0 | 5.0 | 3.0 | 3.0 | 4.0 | 4.0 |
| Toluene, vol. % | 56.2 | 50.7 | 52.2 | 52.8 | 52.7 | 53.0 |
| Isopentane, vol. % | 3.8 | 4.2 | 6.1 | 7.5 | 5.1 | 6.0 |
| Alkylate, vol. % | 25.0 | 33.1 | 28.7 | 28.7 | 28.2 | 30.0 |
| MTBE, vol. % | 10.0 | 7.0 | 10.0 | 8.0 | 10.0 | 7.0 |
| Predicted Octane Value | 100.9 | 100.1 | 100.1 | 100.0 | 100.2 | 100.2 |
| Actual Octane Value | 100.9 | 100.2 | 100.6 | 100.5 | 100.6 | 100.3 |
| RVP (psi) | 6.5 | 7.35 | 6.8 | 6.15 | 5.95 | 7.3 |
| V/L ratio @ 145° F. | 8.0 | 8.1 | 5.9 | 4.7 | 5.7 | 8.2 |
| Dist. 10% (°F.) | 151 | 150 | 154 | 146 | 146 | 146 |
| Dist. 50% (°F.) | 217 | 217 | 217 | 216 | 216 | 217 |
| Dist. 90% (°F.) | 228 | 230 | 229 | 228 | 229 | 229 |

The data in Table 3 show that all the fuel compositions had actual octane ratings of 100 or more, and all were within 0.5 unit of the predicted octane rating. In addition, all of the blends in Table 3 met the requirements for ASTM D439 Class A unleaded gasolines, and three met the requirements for ASTM D439 Class B unleaded gasolines.

The data in Table 3 coupled with that for Blend #1 in Table 1, show that many fuel compositions containing ingredients as shown in the following Table 4 can readily be produced to meet the minimum octane rating requirement of the present invention of about 100.

TABLE 4

| | |
|---|---|
| Butane | 1 to 5 vol. % |
| Toluene | 48 to 60 vol. % |
| Isopentane | 2 to 8 vol. % |
| Alkylate | 20 to 35 vol. % |
| MTBE | 5 to 10 vol. % |

EXAMPLE III

In this Example, it is shown that a fuel containing no MTBE, but still prepared in accordance with the octane formula, has an octane value of at least 100. The fuel composition is specified in Table 5, along with the predicted and actual octane values and other properties.

TABLE 5

| Blend #8 | |
|---|---|
| Butane | 5 vol. % |
| Toluene | 60 vol. % |
| Isopentane | 6.4 vol. % |
| Alkylate | 28.6 vol. % |
| MTBE | 0.0 vol. % |
| Predicted Octane Value | 100.4 |
| Actual Octane Value | 100.5 |
| RVP (psi) | 7.1 |
| V/L ratio at 145° F. | 6.3 |
| Dist. 10% (°F.) | 155 |
| Dist. 50% (°F.) | 220 |
| Dist. 90% (°F.) | 229 |

As shown by the data in Table 5, blend #8 had an octane rating above 100 and met the requirements of an ASTM D439 Class A unleaded gasoline. In using the octane formula, it has been found that little deviation is possible from the formulation of Blend #8 if what is desired is an MTBE-free gasoline fuel of octane rating at or above 100. Specifically, the values given in Table 5 should vary by no more than about 1 volume percent for each of the four components listed.

EXAMPLE IV

In this Example, a fuel composition, containing no butane, is prepared in accordance with the requirement of the octane formula and shown to have an observed octane value in excess of 100.

TABLE 6

| Blend #9 | |
|---|---|
| Butane | 0.0 vol. % |
| Toluene | 57.0 vol. % |
| Isopentane | 11.0 vol. % |
| Alkylate | 22.0 vol. % |
| MTBE | 10.0 vol. % |
| Predicted Octane Value | 100.9 |
| Actual Octane Value | 100.9 |
| RVP (psi) | 6.3 |
| V/L ratio at 145° F. | 1.1 |
| Dist. 10% (°F.) | 157 |
| Dist. 50% (°F.) | 217 |
| Dist. 90% (°F.) | 229 |

As shown by the data in Table 6, blend #9 had an octane rating above 100 and met the requirements of ASTM D439 Class A unleaded gasoline. Data derived from use of the octane formula indicate that blend #9 is but one of many butane-free formulations within the ranges shown in the following Table 7 which have a predicted octane rating of 100 or more.

TABLE 7

| | |
|---|---|
| Toluene | 46 to 60 vol. % |
| Isopentane | 7 to 15 vol. % |
| Alkylate | 15 to 35 vol. % |
| MTBE | 5 to 10 vol. % |

EXAMPLE V

It was shown in the previous examples that the fuels met the appropriate requirements of ASTM D439 Class A gasoline fuels and, in some instances, ASTM D439 Class B gasoline fuels as well. In the present example, it will be shown how, by adding isobutylene or isobutane to Blend #9 of Example IV, one can alter the characteristics of a Class A fuel of the invention to provide a fuel meeting the requirements of Class B, C, and/or D fuel specified in ASTM D439.

Blend #9 was blended with isobutane in a 95:5 volume ratio (blend #10) and in a 90:10 volume ratio (blend #11) and with isobutylene in a 95:5 volume ratio (blend #12) and 90:10 volume ratio (Blend #13). The properties of the resultant fuels were then determined and listed in Table 8, as follows:

TABLE 8

| Blend # | 9 | 10 | 11 | 12 | 13 |
|---|---|---|---|---|---|
| Toluene, vol. | 57 | 54.15 | 51.3 | 54.15 | 51.3 |
| Isopentane, vol. % | 11 | 10.45 | 9.9 | 10.45 | 9.9 |
| Alkylate, vol. % | 22 | 20.9 | 19.8 | 20.9 | 19.8 |
| MTBE, vol. % | 10 | 9.5 | 9.0 | 9.5 | 9.0 |
| Isobutane, vol. % | 0 | 5.0 | 10.0 | 0 | 0 |
| Isobutylene, vol. % | 0 | 0 | 0 | 5.0 | 10.0 |
| Actual Octane Value | 101.0 | 100.3 | 99.9 | 100.1 | 99.5 |
| RVP (psi) | 5.2 | 9.7 | 12.6 | 8.9 | 12.45 |
| V/L @ 145° F. | 1.1 | 4.3 | >35 | >35 | >35 |
| Dist. 10% (°F.) | 153 | 141 | 132 | 136 | 106 |
| Dist. 50% (°F.) | 216 | 217 | 219 | 218 | 215 |
| Dist. 90% (°F.) | 227 | 229 | 232 | 230 | 226 |

As shown by the data in the foregoing Table 8, one can add up to about 10% by volume of isobutane or up to about 6% isobutylene to blend #9 before the octane rating of the fuel drops below 100. Note that blend #10 meets the requirements of Class A and B gasoline fuels, and #12 meets the requirements of Class A, B, and C gasoline fuels, and #13 meets the requirements of class D gasoline fuels. The data for blend #11 indicate that it also is within experimental error of meeting the requirements of Class D gasoline fuel.

Although the invention has been described in conjunction with specific embodiments and examples thereof, it is evident that many alternatives, modifications, and variations will be apparent to those skilled in the art in light of the foregoing description. It is intended to embrace all such alternatives, modifications, and variations as fall within the spirit and scope of the appended claims.

I claim:

1. An unleaded fuel composition havng an octane rating of about 100 or more, said fuel comprising toluene and alkylate and at least two further components selected from the group consisting of methyl tertiary-butyl ether, isopentane, and n-butane.

2. The fuel composition of claim 1 comprising the components shown in the following table in the concentration ranges indicated:

| | |
|---|---|
| Toluene | 46 to 60 vol. % |
| Isopentane | 7 to 15 vol. % |
| Alkylate | 15 to 35 vol. % |
| MTBE | 5 to 10 vol. % |

3. The fuel composition of claim 1 comprising the components shown in the following table in the concentration ranges indicated:

| | |
|---|---|
| Toluene | 48 to 60 vol. % |
| Isopentane | 2 to 8 vol. % |
| Alkylate | 20 to 35 vol. % |
| MTBE | 5 to 10 vol. % |
| n-butane | 1 to 5 vol. % |

4. A fuel composition comprising a volatility trimming agent selected from the group consisting of isobutylene and isobutane blended with the fuel of claim 1, with the blend conforming to the formula: X+Y=100, where X is the volumetric percent of volatility trimming agent and Y is the volumetric percent of fuel composition, with X being at least about 1 volume percent.

5. The fuel composition of claim 4 being essentially free of any component other than isopentane, n-butane, toluene, alkylate, methyl tertiary-butyl ether, isobutane, and isobutylene.

6. The fuel composition of claim 5 wherein the volumetric concentration of the volatility trimming agent is no greater than about 9 volume percent.

7. The fuel composition of claim 6 containing isobutane but no isobutylene.

8. The fuel composition of claim 5 wherein the volumetric concentration of the volatility trimming agent is no greater than about 6 volume percent.

9. The fuel composition of claim 8 containing isobutylene but no isobutane.

10. The fuel composition of claim 1 wherein the fuel components of toluene, alkylate, isopentane, n-butane, and methyl tertiary-butyl ether concentrations, when inserted into the following equation yield a value for OV of 99 or more:

$$OV = 7.427B + 0.3476I + 0.92922A + 1.07801T + 0.095M - 0.06170BI - 0.06967BA - 0.06973BT - 0.05728BM + 0.005629IA + 0.00567IT + 0.01705IM - 0.000311AT + 0.01189AM + 0.00912TM$$

where OV is the octane value, B is the concentration of butane in volume percent, I is the concentration of isopentane in volume percent, A is the concentration of alkylate in volume percent, T is the concentration of toluene in volume percent, and M is the concentration of MTBE in volume percent.

11. The fuel composition of claim 10 wherein said fuel components are present in concentrations such that the OV value calculated by the equation is 100 or more.

12. The fuel composition of claim 11 being an unleaded gasoline of octane rating of at least 100, said gasoline conforming to the following specifications:

| | |
|---|---|
| Reid Vapor Pressure | 10 psi max. |
| Dist. 10% | 149° F. max. |
| Dist. 50% | 170°-245° F. |
| Dist. 90% | 374° F. max. |

13. The fuel composition of claim 10 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

14. The fuel composition of claim 10 wherein said fuel components are present in concentrations such that the OV value calculated by the equation is 101 or more.

15. The fuel composition of claim 1 wherein the n-butane concentration is no more than about 5 volume percent, the isopentane no more than about 15 volume percent, the alkylate no more than about 90 volume percent, the toluene no more than about 60 volume percent, and the methyl tertiary-butyl ether no more than about 10 volume percent.

16. The fuel composition of claim 1 wherein isopentane is present in at least a concentration of 2 volume percent, toluene at least 46 volume percent, and alkylate is at least 15 volume percent.

17. The fuel composition of claim 16 wherein n-butane is present in at least a concentration of 1 volume percent.

18. The fuel composition of claim 17 wherein methyl tertiary-butyl ether is present in at least a concentration of 5 volume percent.

19. The fuel composition of claim 16 wherein methyl tertiary-butyl ether is present in at least a concentration of 5 volume percent.

20. The fuel composition of claim 1 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

21. The fuel composition of claim 1 being an unleaded gasoline of octane rating of a least 100, said gasoline conforming to the following specifications:

| | |
|---|---|
| Reid Vapor Pressure | 10 psi max. |
| Dist. 10% | 149° F. max. |
| Dist. 50% | 170°-245° F. |
| Dist. 90% | 374° F. max. |

22. The fuel composition of claim 1 being an unleaded gasoline of octane rating of at least 100, said gasoline conforming to the following specifications:

| | |
|---|---|
| Reid Vapor Pressure | 11.5 psi max. |
| Dist. 10% | 140° F. max. |
| Dist. 50% | 170°-240° F. |
| Dist. 90% | 365° F. max. |

23. The fuel composition of claim 1 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

24. The fuel composition of claim 1 wherein the octane rating of the fuel composition is at least 100.5.

25. The fuel composition of claim 1 containing no more than 1.0 volume percent of any component other than isopentane, n-butane, toluene, alkylate, and methyl tertiary-butyl ether.

26. The fuel composition of claim 1 wherein the alkylate has a motor octane value and a research octane value each of at least 95.

27. The fuel composition of claim 1 free of any ingredient or combination of ingredients which increases or decreases the octane value of the fuel by more than 1.0 unit.

28. The fuel composition of claim 1 free of any ingredient or combination of ingredients which increases or decreases the octane value of the fuel by more than 0.5 unit.

29. The fuel composition of claim 1 free of any ingredient or combination of ingredients which increases or decreases the octane value of the fuel by more than 0.2 unit.

30. The fuel composition of claim 1 wherein at least 99% by volume of said fuel composition is a mixture of toluene and alkylate and at least two components consisting of methyl tertiary-butyl ether, isopentane, and n-butane.

31. The fuel composition of claim 1 wherein at least 95% by volume of said fuel composition is a mixture of toluene and alkylate and at least two components consisting of methyl tertiary-butyl ether, isopentane, and n-butane.

32. The fuel composition of claim 1 wherein at least 90% by volume of said fuel composition is a mixture of toluene and alkylate and at least two components consisting of methyl tertiary-butyl ether, isopentane, and n-butane.

33. The fuel composition of claim 1 wherein at least 85% by volume of said fuel composition is a mixture of toluene and alkylate and at least two components consisting of methyl tertiary-butyl ether, isopentane, and n-butane.

34. The fuel composition of claim 1 wherein said alkylate has both a research octane and motor octane rating of at least 100.

35. The fuel composition of claim 1 wherein said alkylate has both a research octane and motor octane rating of at least 98.

36. A fuel composition having an octane rating of about 100 or more and consisting essentially of toluene and alkylate, and at least two further components selected from the group consisting of methyl tertiary-butyl ether, isopentane, and n-butane.

37. The fuel composition of claim 36 consisting essentially of the components shown in the following table in the concentration ranges indicated:

TABLE 7

| | |
|---|---|
| Toluene | 46 to 60 vol. % |
| Isopentane | 7 to 15 vol. % |
| Alkylate | 15 to 35 vol. % |
| MTBE | 5 to 10 vol. % |

38. The fuel composition of claim 37 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

39. The fuel composition of claim 36 consisting essentially of the components shown in the following table in the concentration ranges indicated:

| | |
|---|---|
| Toluene | 48 to 60 vol. % |
| Isopentane | 2 to 8 vol. % |
| Alkylate | 20 to 35 vol. % |
| MTBE | 5 to 10 vol. % |
| n-butane | 1 to 5 vol. % |

40. The fuel composition of claim 39 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

41. The fuel composition of claim 36 consisting essentially of about 4 to 6 volume percent n-butane, about 5.4 to 7.4 volume percent isopentane, about 59 to 61 volume percent toluene, and about 27.6 to 29.6 volume percent alkylate.

42. The fuel composition of claim 36 wherein the n-butane concentration is no more than about 5 volume percent, the isopentane no more than about 15 volume percent, the alkylate no more than about 90 volume percent, the toluene no more than about 60 volume percent, and the methyl tertiary-butyl ether no more than about 10 volume percent.

43. The fuel composition of claim 42 wherein the octane rating of the fuel composition is at least 100.5.

44. The fuel composition of claim 42 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

45. The fuel composition of claim 44 wherein the V/L ratio at 145° F. is no greater than about 8.5.

46. The fuel composition of claim 42 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

47. The fuel composition of claim 42 being an unleaded gasoline of octane rating of at least 100, said gasoline conforming to the following specifications:

| | |
|---|---|
| Reid Vapor Pressure | 10 psi max. |
| Dist. 10% | 149° F. max. |
| Dist. 50% | 170°-245° F. |
| Dist. 90% | 374° F. max. |

48. The fuel composition of claim 42 wherein said fuel composition is a gasoline.

49. The fuel composition of claim 42 wherein said alkylate consists essentially of a mixture of hydrocarbons, at least 90% of which by volume are branched chain paraffins, said alkylate boiling in the range of 75° to 400° F.

50. The fuel composition of claim 42 wherein the alkylate consists essentially of isooctane.

51. The fuel composition of claim 42 wherein the fuel components of toluene, alkylate, isopentane, n-butane, and methyl tertiary-butyl ether concentrations, when inserted into the following equation yield a value for OV of 99 or more:

$$OV = 7.427B + 0.3476I + 0.92922A + 1.07801T + 0.095M - 0.06170BI - 0.06967BA - 0.06973BT - 0.05728BM + 0.005629IA + 0.00567IT + 0.01705IM - 0.000311AT + 0.01189AM + 0.00912TM$$

where OV is the octane value, B is the concentration of butane in volume percent, I is the concentration of isopentane in volume percent, A is the concentration of alkylate in volume percent, T is the concentration of toluene in volume percent, and M is the concentration of MTBE in volume percent.

52. The fuel composition of claim 51 wherein said fuel components are present in concentrations such that the OV value calculated by the equation is 101 or more.

53. The fuel composition of claim 51 being an unleaded gasoline of octane rating of at least 100, said gasoline conforming to the following specifications:

| | |
|---|---|
| Reid Vapor Pressure | 11.5 psi max. |
| Dist. 10% | 140° F. max. |
| Dist. 50% | 170°-240° F. |
| Dist. 90% | 365° F. max. |

54. The fuel composition of claim 51 wherein said fuel components are present in concentrations yielding an OV of 99.5 or more.

55. The fuel composition of claim 51 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

56. The fuel composition of claim 51 wherein said fuel components are present in concentrations yielding an OV of 99.7 or more.

57. The fuel composition of claim 51 wherein said fuel components are present in concentrations such that the OV value calculated by the equation is 100.5 or more.

58. The fuel composition of claim 51 wherein said fuel components are present in concentrations such that the OV value calculated by the equation is 100 or more.

59. The fuel composition of claim 58 wherein said alkylate boils in the range of 240° to 300° F.

60. The fuel composition of claim 58 wherein said alkylate boils in the range of 300° to 350° F.

61. The fuel composition of claim 58 wherein said alkylate boils in the range of 355° to 410° F.

62. The fuel composition of claim 58 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

63. The fuel composition of claim 62 wherein the V/L ratio at 145° F. is no greater than about 8.5.

64. The fuel composition of claim 58 wherein at least 75 percent by volume of the alkylate is isooctane.

65. The fuel composition of claim 58 wherein at least 90 percent of said alkylate is branched chain paraffins, at least 50% of which is isooctane, the remainder consisting essentially of organic compounds.

66. The fuel composition of claim 65 wherein said alkylate consists essentially of hydrocarbons and boils in the range of 75° to 400° F.

67. The fuel composition of claim 58 being an unleaded gasoline of octane rating of at least 100, said gasoline conforming to the following specifications:

| | |
|---|---|
| Reid Vapor Pressure | 9 psi max. |
| Dist. 10% | 158° F. max. |
| Dist. 50% | 170°-250° F. |
| Dist. 90% | 374° F. max. |

68. The fuel composition of claim 67 wherein the V/L ratio at 145° F. is no greater than about 8.5.

69. The fuel composition of claim 68 wherein the octane rating of the fuel composition is at least 100.5.

70. The fuel composition of claim 69 wherein said alkylate consists essentially of hydrocarbons, with at least 90 percent of said alkylate being branched chain paraffins, at least 50% of which paraffins is isooctane, said alkylate boiling in the range of 90° to 375° F.

71. The fuel composition of claim 68 wherein said alkylate consists essentially of hydrocarbons, with at least 90 percent of said alkylate being branched chain paraffins, at least 50% of which paraffins is isooctane, said alkylate boiling in the range of 90° to 375° F.

72. The fuel composition of claim 58 wherein isopentane is present in at least a concentration of 2 volume percent, toluene at least 46 volume percent, and alkylate concentration at least 15 volume percent.

73. The fuel composition of claim 72 being an unleaded gasoline of octane rating of at least 100, said gasoline conforming to the following specifications:

| | |
|---|---|
| Reid Vapor Pressure | 11.5 psi max. |
| Dist. 10% | 140° F. max. |
| Dist. 50% | 170°-240° F. |
| Dist. 90% | 365° F. max. |

74. The fuel composition of claim 72 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

75. The fuel composition of claim 72 wherein n-butane is present in at least a concentration of 1 volume percent.

76. The fuel composition of claim 75 wherein methyl tertiary-butyl ether is present in at least a concentration of 5 volume percent.

77. The fuel composition of claim 76 being an unleaded gasoline of octane rating of at least 100, said gasoline conforming to the following specifications:

| | |
|---|---|
| Reid Vapor Pressure | 10 psi max. |
| Dist. 10% | 149° F. max. |
| Dist. 50% | 170°-245° F. |

-continued

| | |
|---|---|
| Dist. 90% | 374° F. max. |

78. The fuel composition of claim 72 wherein methyl tertiary-butyl ether is present in at least a concentration of 5 volume percent.

79. The fuel composition of claim 78 being an unleaded gasoline of octane rating of at least 100, said gasoline conforming to the following specifications:

| | |
|---|---|
| Reid Vapor Pressure | 11.5 psi max. |
| Dist. 10% | 140° F. max. |
| Dist. 50% | 170°-240° F. |
| Dist. 90% | 365° F. max. |

80. The fuel composition of claim 78 being an unleaded gasoline of octane rating of at least 100, said gasoline conforming to the following specifications:

| | |
|---|---|
| Reid Vapor Pressure | 13 psi max. |
| Dist. 10% | 131° F. max. |
| Dist. 50% | 170°-234° F. |
| Dist. 90% | 365° F. max. |

81. The fuel composition of claim 80 wherein the V/L ratio at 145° F. is no greater than about 8.5.

82. The fuel composition of claim 81 wherein the octane rating of the fuel composition is at least 100.5.

83. The fuel composition of claim 81 wherein said alkylate consists essentially of hydrocarbons, with at least 90 percent of said alkylate being branched chain paraffins, at least 50% of which paraffins is isooctane, said alkylate boiling in the range of 90° to 375° F.

* * * * *